US005523931A

United States Patent [19]

Kassay et al.

[11] Patent Number: 5,523,931

[45] Date of Patent: Jun. 4, 1996

[54] HIGH LUMEN OUTPUT FLUORESCENT LAMP FIXTURE

[75] Inventors: Charles E. Kassay; J. Peter Kassay; Marc A. Kassay, all of Smithtown, N.Y.

[73] Assignee: Intrepid Lighting Manufacturing, Inc., Ronkonkoma, N.Y.

[21] Appl. No.: 225,057

[22] Filed: Apr. 8, 1994

[51] Int. Cl.[6] ..... F21V 11/00

[52] U.S. Cl. ..... 362/235; 362/225; 362/245; 362/260; 362/327

[58] Field of Search ..... 362/225, 235, 362/260, 297, 404, 216, 244, 245, 246, 327, 363, 355, 356, 361

[56] References Cited

U.S. PATENT DOCUMENTS

| | | | |
|---|---|---|---|
| 2,194,431 | 3/1940 | O'Neil | 362/297 |
| 2,222,319 | 11/1940 | Millar et al. | 362/245 |
| 3,643,088 | 2/1972 | Osteen et al. | 362/404 |
| 3,735,329 | 5/1973 | Funabashi et al. | 339/89 R |
| 4,367,417 | 1/1983 | Casasanta | 362/225 X |
| 4,520,436 | 5/1985 | McNair et al. | 362/366 |
| 4,595,969 | 6/1986 | McNair | 362/217 |
| 4,704,664 | 11/1987 | McNair | 362/225 |
| 4,802,073 | 1/1989 | Plumly | 362/251 |
| 4,839,781 | 6/1989 | Barnes et al. | 362/299 |
| 4,922,393 | 5/1990 | McNair | 362/225 |
| 5,197,798 | 3/1993 | Tickner | 362/235 |
| 5,377,086 | 12/1994 | Tickner | 362/235 |

FOREIGN PATENT DOCUMENTS

| | | |
|---|---|---|
| 1085180 | 1/1955 | France . |
| 945777 | 7/1956 | Germany . |
| 4-75204 | 3/1992 | Japan . |
| 878534 | 10/1961 | United Kingdom . |

OTHER PUBLICATIONS

Lighting Sciences, Inc., 7830 E. Evans Rd., Scottsdale, AZ USA 85260; Certified Test Report #LSI10775, dated May 5, 1992.

Luminaire Testing Laboratory, 905 Harrison Street, Allentown, PA 18103, Report #01481, dated Feb. 24, 1994.

Tupper Lighting Applications, POB 794, Baldwinville, NY 13027, Maxi-9 Analysis, dated Mar. 8, 1994.

*Primary Examiner*—Stephen F. Husar

*Attorney, Agent, or Firm*—Alfred M. Walker

[57] ABSTRACT

An alternative lighting system luminaire to conventional high intensity discharge light fixtures such as mercury vapor, metal halide, high pressure sodium lighting fixtures includes a translucent reflector/refractor with a starburst pattern of fluorescent lights to provide both greater lumen production per watt with uplight capabilities for an even distribution of light. This system allows one-for-one fixture replacement when substituted for 400 watt metal halide and 1000 watt mercury vapor high intensity discharge lighting fixtures in design or replacement applications. The luminaire utilizes very high efficiency "Dulux L" high lumen compact fluorescent lamps, which each are shaped like a single inverted "U" and are a minimum of 16 inches long. The lamps extend from the base of reflector and/or refractor in a starburst pattern, wherein the lamps extend both downward and outward. The lamps are secured and powered by clamping sockets fastened to a plate, which is mounted in a range extending from at the base to approximately one fourth the distance between the base and the larger end of the reflector and/or refractor. Ballasts are located in an enclosure mounted above and outside, or are remoted from the reflector/refractor.

16 Claims, 7 Drawing Sheets

FIG. 1
PRIOR ART
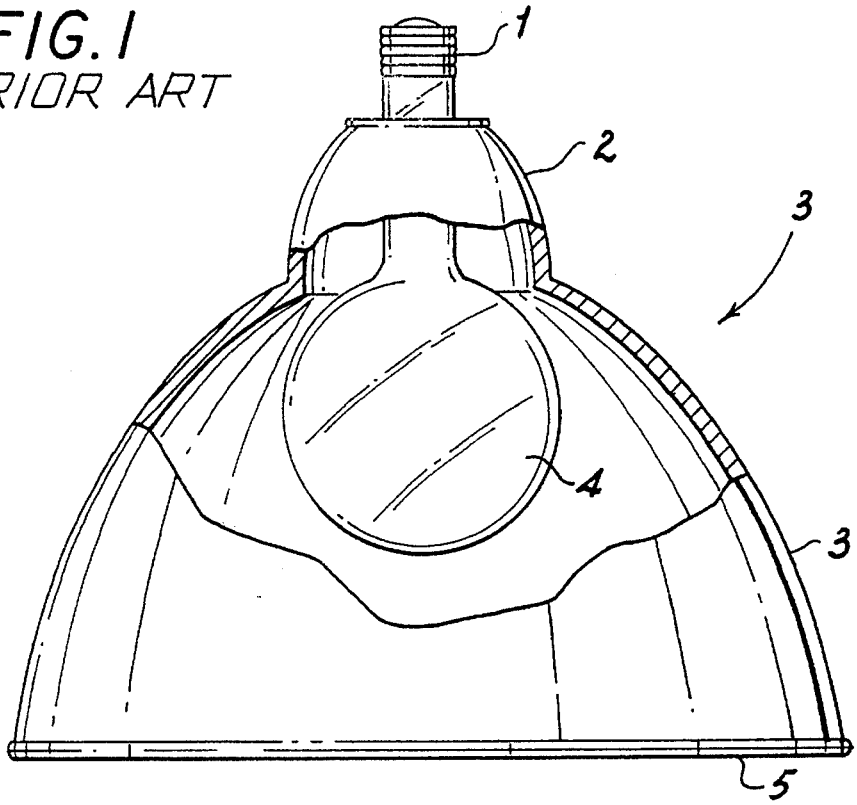
FIG. 2A
PRIOR ART
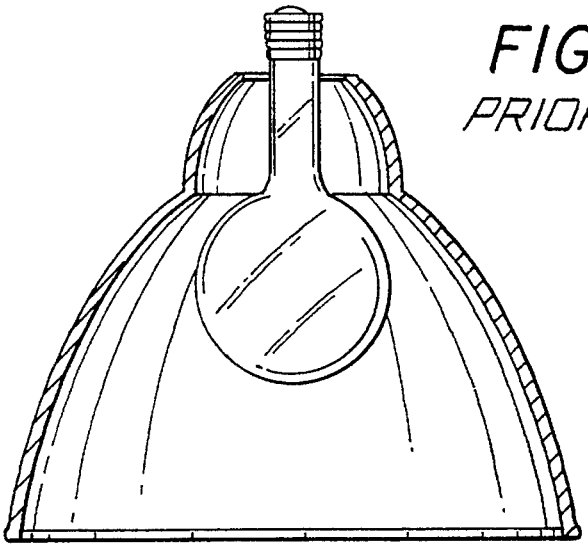
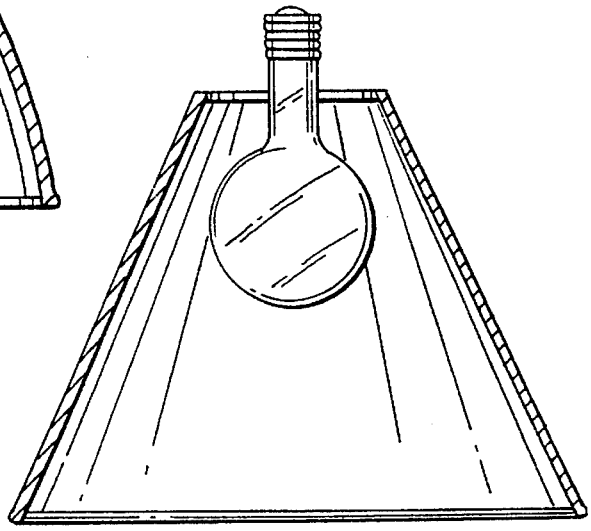
FIG. 2B
PRIOR ART

HIGH LUMEN OUTPUT FLUORESCENT LAMP FIXTURE

FIELD OF THE INVENTION

The present invention relates to a lighting fixture which more efficiently produces lumens for large volume lighting environments.

BACKGROUND OF THE INVENTION

There are many typical uses for high intensity discharge (H.I.D.) lighting fixtures, such as for retail stores, warehouses, commercial buildings, and other uses possessing relatively high ceilings. H.I.D. lighting fixtures have been highly successful due to their extreme amount of output of light. Sources of H.I.D. lighting are mercury vapor, metal halide, and high pressure sodium.

These H.I.D. fixtures typically include a single light source lamp with a solid reflector utilized to direct the light in a downward direction. This reflector is normally a bell shape or conical shape. These prior art reflectors are made of reflective substances such as polished aluminum to enhance the efficiency of the fixture. The single lamp supplies direct light and light reflected off the reflector in a downward direction.

The great quantity of light supplied by these prior art H.I.D. fixtures, combined with a typical 1.5 to 1.7 light coverage criteria, allows for a great light coverage area with fewer fixtures.

The drawbacks to using these prior art H.I.D. light sources are the use of excessive amounts of energy, poor color rendition, diminishing lumen output, no choice of color temperatures, and a lack of high efficiency electronic ballasts to power the H.I.D. light sources.

An alternative prior art source of light has been fluorescent lamped fixtures. These fluorescent lamped fixtures have typically utilized long longitudinally extending cylindrical lamps, which are mounted at or slightly below the ceiling level, parallel to the floor surface. These prior art fluorescent lamp fixtures are usually 1 to 4 tubes of four foot to eight foot lengths per fixture, and these prior art fixtures utilize much lower wattage per fixture than the prior art H.I.D. light fixtures. The fluorescent lamped fixtures illuminate a rectangular area and they are usually placed in rows mounted end to end. The draw back with the prior art fluorescent fixtures is the large quantity of lamp fixtures required and the lack of efficiency. The large quantities of prior art fluorescent fixtures significantly increase the initial installation costs, with no advantage or savings for the increase labor cost, when compared to the installation of prior art H.I.D. light fixtures. The traditional fluorescent lamp also lacks the intensity needed for large spacing for high mounting levels.

New technology has brought about the compact fluorescent lamp bulb, which is a four prong lamp with two sets of joined ends creating a double inverted U effect relative to the base. The normal wattage for these double U-shaped fluorescent lamps is from 5 to 26 wattage per lamp and the double U-shaped fluorescent lamps utilize clip-in socket bases, such as commonly designated as G23, GX23, G23-2, GX23-2, G24d1, G24d2, G24d3, G24q1, G24q2, and G24q3 (Sylvania designation or equal). These U-shaped fluorescent lamps have been designated Dulux S®,Dulux DS/E®, Dulux D®, and Dulux D/E® by Sylvania, with comparable equals produced by other manufacturers.

There have been several prior art patents utilizing these double U-shaped fluorescent lamps and socket combinations. Among the prior art patents are U.S. Pat. Nos. 4,520,436; 4,704,664 and 4,922,393 of McNair and, additionally, U.S. Pat. No. 5,197,798 of Tickner. McNair's patents describe light fixtures which utilize only a pair of these small compact lamps, generally 3.4 inches to 7.6 inches in length. The McNair double U-shaped lamps are mounted as to be askew to each other in a reflector which allows light out one end in quantities enough to replace small incandescent lamps (such as 50 W–100 W) in similar incandescent fixture configurations. The reflector in McNair is also designed with openings in its upper sides to allow for the mounting of the socket, and connection of these sockets to the ballasts, which power the double U-shaped fluorescent lamps from outside the confines of the reflector. The complete light fixture package of McNair is further encased in a larger housing to enclose the wiring, ballasts, and sockets.

The usefulness of these McNair fixtures over incandescent fixtures is that the McNair fixtures can replace higher wattage incandescent fixtures with a high percentage reduction of energy usage. Moreover, the lamp life of the McNair double U-shaped fluorescent lamps utilized is longer than incandescent lamps which the McNair lamps can replace.

Another related prior art patent is that of Tickner, wherein a light fixture utilizes a grouping of 26 watt compact fluorescent "Dulux D" double U-shaped lamps, with either 6 lamps, 8 lamp, or 12 lamps per fixture. Single or pairs of lamps are activated by individual ballasts. The lamps in Tickner are mounted in a solid, non-translucent reflector as to direct all light in a downward direction. The socket mounting plates are mounted within the concave reflector from ¼ to ½ the distance from the narrow base opening of the reflector to the wider light emitting output portion of the reflector. By combining this large number of 26 watt compact double U-shaped fluorescent lamps the Tickner fixture can produce as many as 14,400 initial lumens in an eight light configuration and 21,600 lumens in a 12 lamp configuration. These wattages produced by the Tickner device compare evenly with that of a 250 watt metal halide high intensity discharge lamp or a 200 watt high pressure sodium. This low wattage compact fluorescent light fixture of Tickner produces only approximately 69 lumen per watt, which is a significant drawback. The Tickner fixture at it's maximum potential cannot come near the very popular 400 watt metal halide H.I.D. high intensity discharge lamps for production of lumens, which initially producing 36,000 lumens, with a mean of 29,000 lumens.

Tickner also has the additional draw back of creating no uplight which is the beneficial discharge of light above the plane of the bottom outlet of the lamp reflector. Uplight capabilities prevent a dead unlighted area above the upper hemisphere of a reflector and allows for more even distribution of light. With Tickner, optional lighting capabilities are limited because the opaque reflector prevents uplight. The drawbacks of Tickner are shown in a certified test report completed May 5, 1992 by Lighting Sciences Inc., 7830 E. Evans Road, Scottsdale, Ariz., U.S.A., 85260, test report #LSI10775 (exhibit). In this certified report it is noted that the "Dulux D" 26 watt double U-shaped lamps produce 69.23 lumens per watt and that the overall efficiency of the fixture is 79.1%. Additionally, it is noted that little or no candlepower is produced above 75 degrees and virtually none beyond 90 degrees or in the upper hemisphere. All of the findings of this testing are typical of the Tickner patent and configuration.

OBJECTS OF THE INVENTION

To overcome the disadvantages and drawbacks of the prior art patents, it is a desirable object of the present invention to produce a fixture producing higher quantities of light as to allow for the 1 for 1 replacement of the greater wattage of high intensity discharge light fixtures.

It is a further object of the present inventor to show greater lumen production per watt and a greater efficiency produced by the fixture itself.

It is yet another object to produce uplight capabilities would broaden the possibilities of utilization in not leaving a dead unlighted upper hemisphere.

It is yet another object to produce a light fixture which allows for a more even distribution of light through reflectance through a translucent reflector/refractor.

To improve over the disadvantages of the prior art, it is another object of the present invention to create a superior lighting fixture not only a different one.

It is also a further object of the present invention to utilize the most efficient fluorescent lamp available and to produce the highest efficiency combination of lamp locations, electronic ballasts and reflector and or refractor.

It is yet another object of the present invention to allow for the preselected control of predetermined set of lamp individually to create lower light levels when required and extend lamp change intervals.

SUMMARY OF THE INVENTION

In keeping with these objects and others which will become apparent the present invention includes a luminaire lighting fixture which contains a reflector/refractor, a plurality of multi lamp "Dulux L" single U-shaped compact fluorescent lamps, such as, preferably, lamps which have a Sylvania designation or equal, a plurality of configuration sockets, such as 2G11, 2G7, 2GX7, preferably Sylvania designation or equal, a socket plate holding the sockets, a remote ballast enclosure and wherein the reflector/refractor has an ability to receive a bottom enclosing lens.

The translucent concave reflector and/or refractor of the present invention allows from 1 to 80% uplighting, depending upon the type of material utilized and the method of construction. The reflector and/or refractor of the present invention includes a smaller base end and larger open end, which may possibly be a lens receiving end. The reflector and/or refractor is of a symmetrical concave shape relative to the line extended through the center of itself and/or the entire lighting fixture. A ballast enclosure is fastened at the smaller base end of the reflector and/or refractor. There is also the possibility of remoting the ballast enclosure, to reduce the overall height of the entire assemble.

A socket plate is mounted at the base end of the fixture anywhere, from zero to ½ the distance from the base end to the open or lens receiving end of the reflector and/or refractor.

The lamps utilized are single U-shaped fluorescent lamps, such as "Dulux L" of Sylvania designation or equal, which are compact fluorescent lamps in quantities from 6 to 12 per fixture. The reflector and/or refractor can additionally have the ability to receive a lens to enclose the bottom light emitting end, with or without the ability to refract the produced light.

The single U-shaped fluorescent lamps, such as "Dulux L" lamps, receive their power from ballasts mounted in the ballast enclosure which is attached or alternatively remoted from the fixture of the present invention.

The aforementioned objects and other features of the present invention may be apparent from the description of the drawings, in which:

FIG. 1 is a front elevational view in partial section of a prior art incandescent lighting fixture;

FIGS. 2A and 2B show in partial cross-section front elevational sectional views of a plurality of typical prior art high intensity discharge lighting fixtures;

DETAILED DESCRIPTION OF THE DRAWINGS

Figure 3:
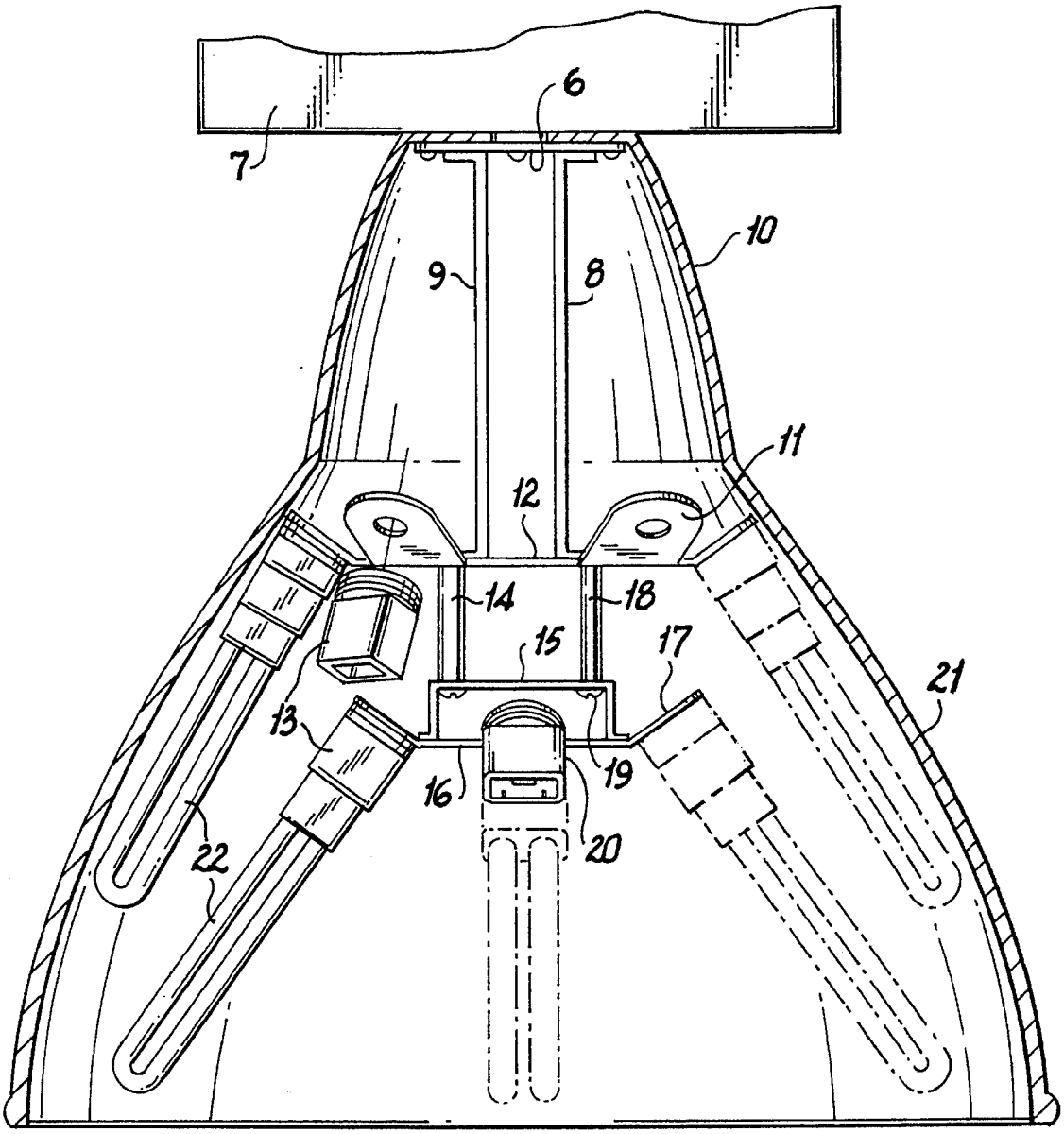
FIG. 3 PRIOR ART
FIG. 3 is a front elevational view in section of a prior art lighting fixture including a plurality of symmetrically placed double U-shaped fluorescent bulbs within a solid, opaque reflector, wherein the support for the bulbs is placed from one fourth to one half of the distance from the base end of the reflector to the light emitting end thereof.

Referring to FIG. 1, designated "Prior Art", there is shown cross sectioned diagram of a typical high intensity discharge (H.I.D.) fixture. H.I.D. fixture units have a large screw-in base (1) which base (1) is screwed into a conventional socket, to receive electrical power from a ballast, to obtain increased voltages to energize the gases in the H.I.D. lamp (4). The light produced by H.I.D. prior art fixtures is totally directed by a concave reflector (3) in a downward direction out an open light emitting end (5) of the high intensity discharge lighting fixture. The base end in which the lamp (4) is mounted is noted by reference numeral (2).

These high intensity discharge lighting fixtures as previously stated are primarily used in warehouses, commercial buildings, and other locations having relatively high ceilings. High intensity discharge lighting fixtures (H.I.D.'s) most commonly use 250 watt, 400 watt, and 1000 watt mercury vapor, metal halide, or high pressure sodium lamps. The light from a high intensity discharge (H.I.D.) lighting fixture can be dispersed by means of a lens attached to the rim at the open end or at light emitting end (5).

FIGS. 2A and 2B show in partial cross-section two typical cross sectional shapes of prior art high intensity discharge H.I.D. reflectors.

FIG. 3 is a diagram of a cross sectional view of the prior art U.S. Pat. No. 5,197,799 Tickner, which shows a ballast enclosure (7) attached above a securing plate (6). Attached to this plate is also a socket mounting assembly including leg braces (8) holding downward there from socket extension tabs (11) emanating from support plate (12). Each socket (13) is fastened to each of the socket extension tabs (11). Socket plate (12) includes 6 or 8 sides to receive 6 or 8 double U-shaped fluorescent lamps. Tickner also describes additional optional provisions to receive 4 lower intermediate lamps to create a 12 lamp fixture. The wires in the Tickner light fixture connect to the sockets (13) and then run through a further upper section (10) back to the ballasts. In Tickner, 26 W-4 pronged double inverted U-shaped lamps (22) of Sylvania designation or equal are plugged into these sockets (13). When illuminated, there is no uplight since all of the light is directed in a downward direction by a solid opaque reflector (21) which allows no light to pass through into the upper hemisphere.

Figure 4:
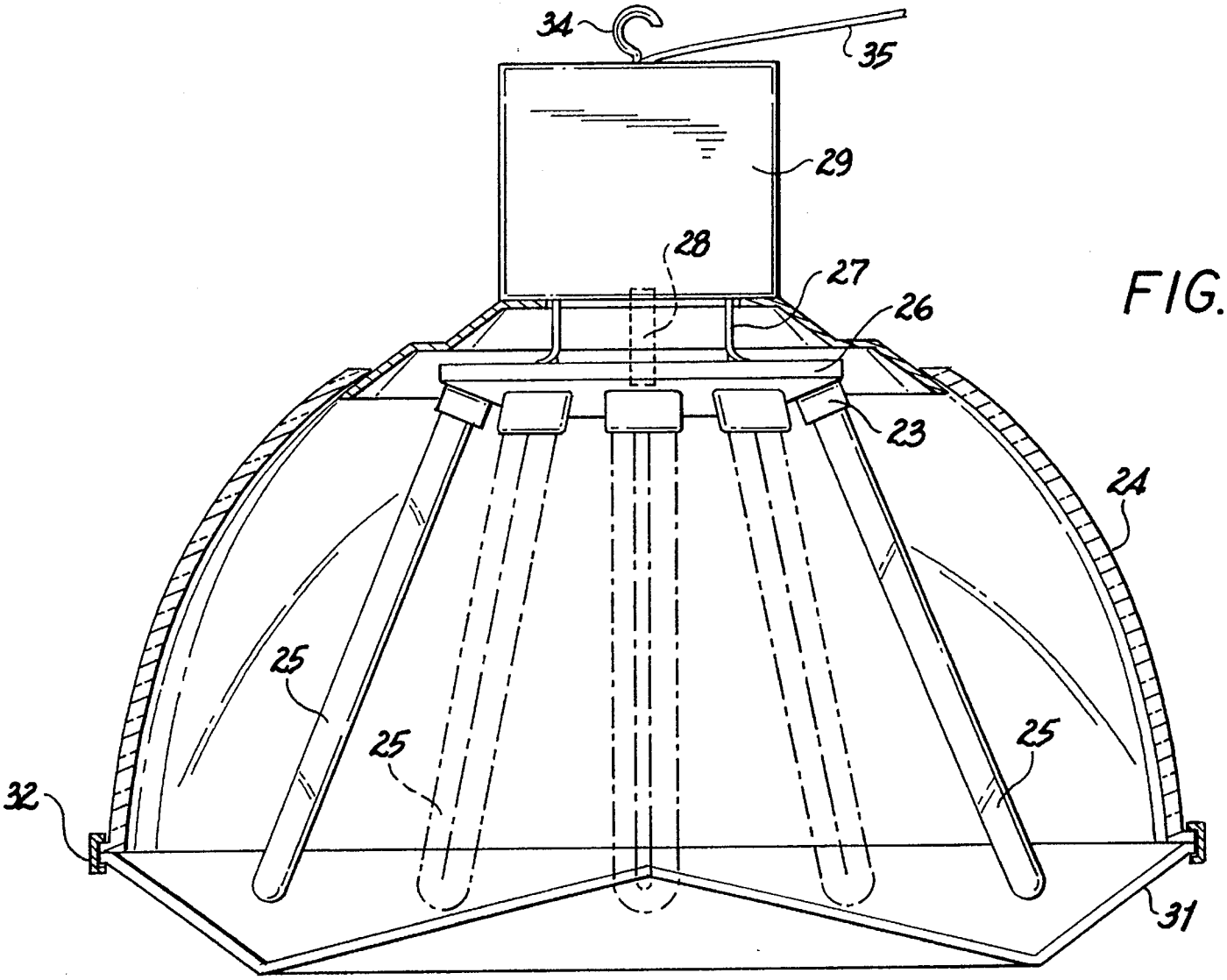
FIG. 4 is a front elevational view in partial section of the lighting fixture of the present invention.
Figure 4A:
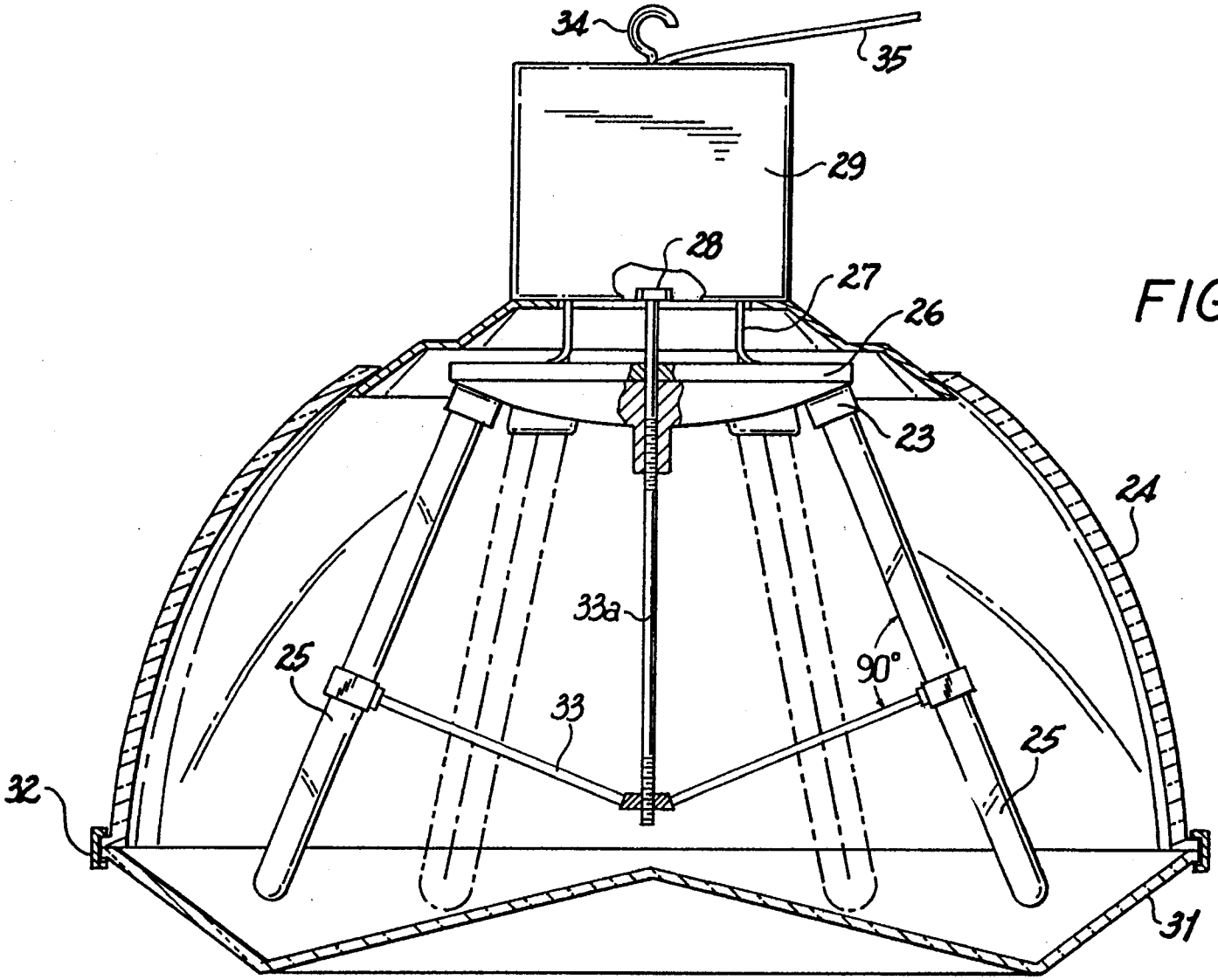
FIG. 4A is a front elevational view of an alternate mounting bracket for the light fixture of the present invention.
Figure 4B:
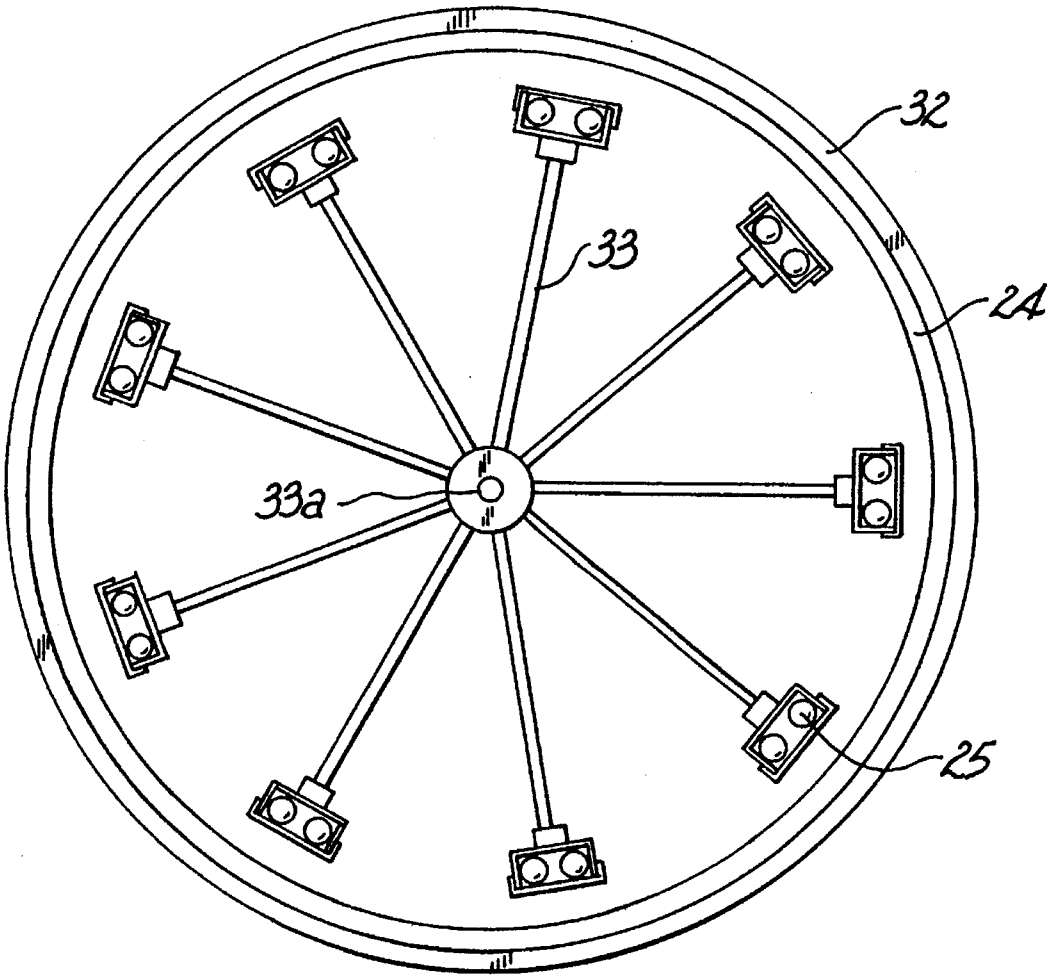
FIG. 4B is a top plan view of the alternate mounting bracket for the light fixture of the present invention, as in FIG. 4A.
Figure 5:
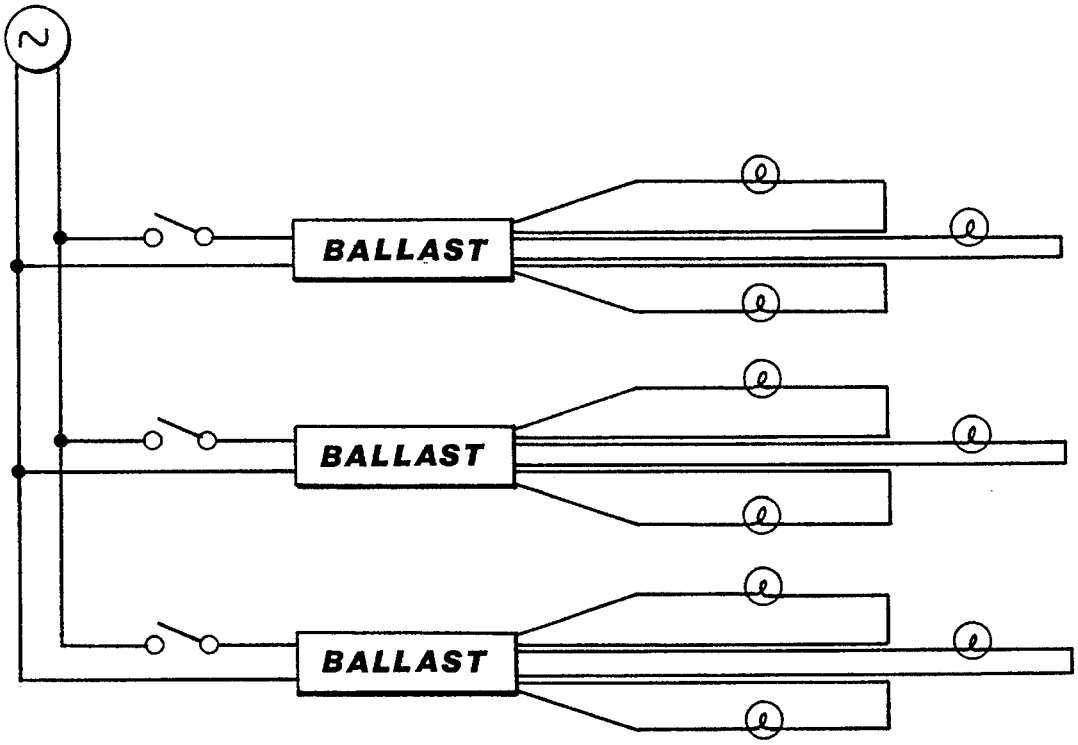
FIG. 5 is an electrical schematic of the present invention.
Figure 6:
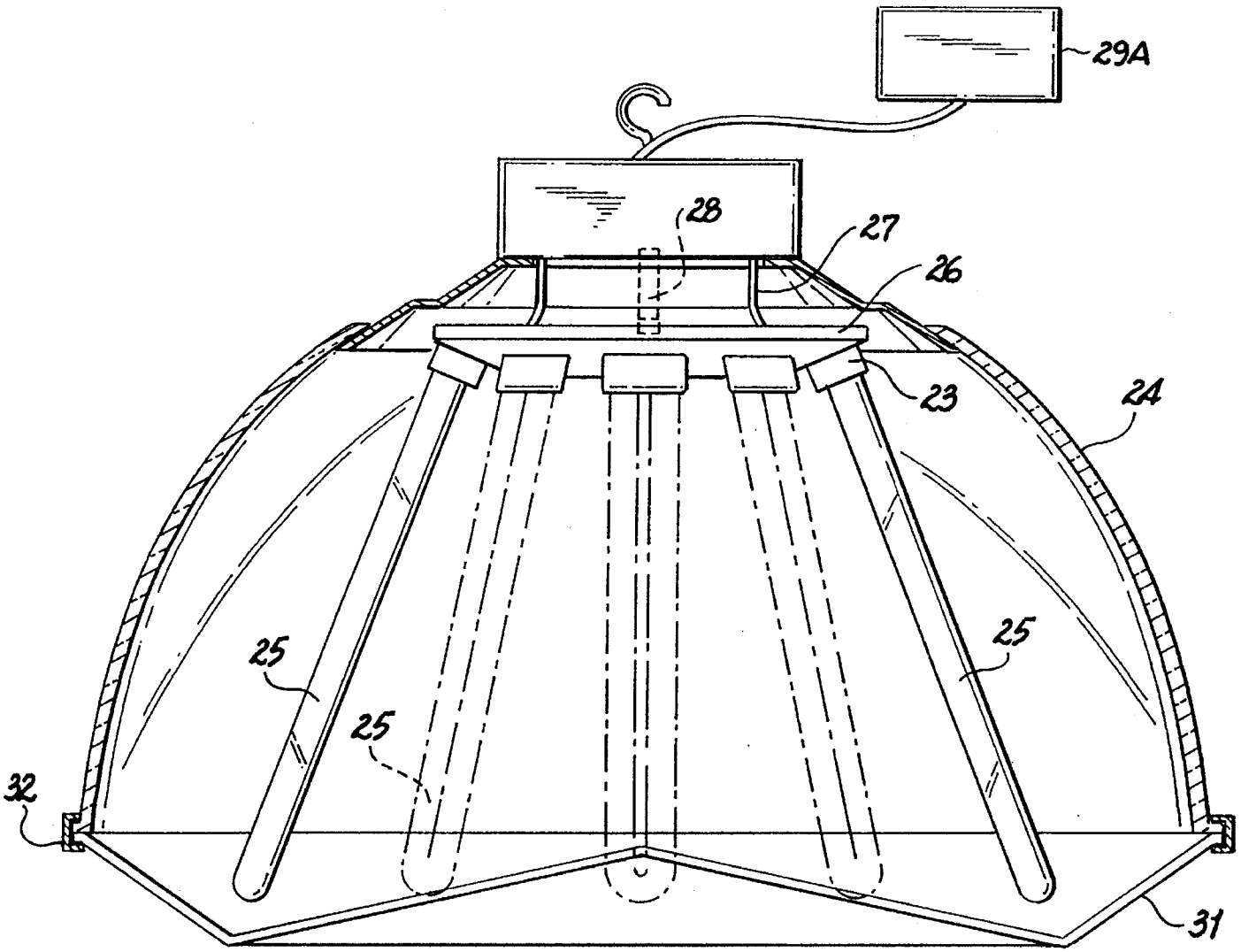
FIG. 6 is a front elevational view in partial section of an alternate embodiment of the lighting fixture of the present invention with a remote ballast compartment.

In contrast to the prior art light devices, the present invention is described in FIG. 4, which is a cross sectional view of the new design of the present invention, which includes a lighting fixture having a reflector/refractor (24) including a ballast compartment (29) which ballast compartment (29) is mounted directly above the fixture or remoted with remote ballast compartment 29A whenever overall fixture height needs to be reduced. Enclosed in the ballast compartment (29) are sets of ballasts which power either 2 or 3 lamps per ballast. The ballasts receive their power through a cord and plug unit (35) which can have 1 to 4 circuits within it for individual control of these ballasts, with a plug to match those requirements. The lighting fixture of the present invention can also be optionally directly wired with no cord end. Below the ballast compartment enclosure (29) is located a chase assembly (28) which allows for the ballast leads which power the lamps to be sleeved down to the sockets (23) to which they are connected. There is also provided a plate assembly (27) which serves the purpose of supporting the reflector/or refractor (24) wherein the plate assembly collar (27) attaches to the socket mounting plate (26) at the base end of reflector/refractor (24). Socket mounting plate (26) is designed to receive from 6 to 12 "Dulux L" lamp sockets (23) as it possesses a quantity of sides to match the quantity of lamps (25) desired. The standard designation of these sockets (23) are 2G11, 2G7, and GX11 of a Sylvania designation or equal configuration. Sockets (23) can be used that have an additional ability to clamp the 4 electrical contact pins of the "Dulux D" lamps (25) into place. This clamping mechanism secures the lamp from slipping in a downward direction. The lamp (25) can be optionally and additionally supported by a mounting bracket (33), as shown in FIGS. 4A and 4B which mounting bracket (33) is attached to a center axis post (33*a*) which runs up to the socket mounting plate (26).

The lamps (25) utilized are referred to as Dulux L (Sylvania designated or equal) compact fluorescents and come in wattages from 18 watts to 55 watts. The fixture of the present invention utilizes only lamps (25) in the 32 watt to 55 watt range, due to the objective of providing maximum light outputs. The lamps (25) range in length from 16.6" to 22.6" and have rated lives of 10,000 to 20,000 hours and beyond.

The light created by these lamps (25) is then optically controlled by a combination of the concave reflector and/or refractor (24) and the possible optional addition of a light diffusing lens (31) held in place by a band clamp or fasteners (32).

The use of a concave translucent refractor/reflector (24) allows for the beneficial results or providing uplight capabilities, by allowing a preset quantity of uplight, from 0 to 80 percent of total light generated. This uplight capability allows for a very even distribution of light through reflectance, as shown by supporting test data of Luminaire Testing Laboratory, 905 Harrison Street, Allentown, Pa. 18103, report #01481 on the 9 lamp unit and a further testing comparison of Tupper Lighting Applications, P.O. Box 794, Baldwinsville, N.Y. 13027 for Interior Lighting Point by Point calculations which utilize the Luminaire Testing Laboratories finding to calculate projected installation light levels. It is noted that these tests are based on a 9 lamp "Dulux L" with three energy efficient electronic ballast fixture with 3 lamps per electronic ballast. The lamps used were FT39DL/841 (Sylvania) rated at 2900 lumens each.

The test data supports the fact that the fixtures of the present invention are capable of replacing conventional light fixtures 400 watt metal halide light fixtures on a 1 for 1 basis with approximately equal light levels.

The great advantages of the light fixture of the present invention is that it requires only 305 watts Vs 465 watts required for a metal halide high intensity discharge light fixture. The great efficiency of the present invention is created by the high lumen output per watt produced by the nine lamps (25), for a total of 26,100 lumens, at 305 watts or 85.57 lumens per watt. Additionally, the fixture has a efficiency rating of an excellent 86.1%. This fixture produces 9856 lumens in the upper hemisphere (90 degrees to 180 degrees) which creates an excellent even distribution of light. Unlike the prior art H.I.D. fixtures, the lamps of the present invention retain approximately 90% of their lumen production over their expected life.

The lamps ballast combination offers an instant restart, as opposed to the extended warm up time required by conventional prior art H.I.D. lamps. The color rendition of the single U-shaped fluorescent lamp bulbs is also far superior to that of H.I.D. lamps. Overall, the only advantage of H.I.D. lighting had over conventional fluorescent light fixtures was the great amount of lumen produced per fixture. Now the novel fixture of the present invention negates that advantage.

Beyond the advantages of greater lumens per fixture, as shown in the testing of a 9 lamp 305 watt fixture, as noted above, the light fixtures of the present invention has the ability to add or delete lamps (25), from 6 to 12 lamps, on a matching socket plate (26) and to change the wattage of the lamps (25) from 32 watts to 55 watts, which produces a fixture with a maximum lumens produce of 57,600 lumens. This results in providing more light than the mean lumens produced by 2–400 watt metal halide high intensity discharge lamps. The test data for such a light fixture with 55 watt lamps (25) would be affected on an approximately proportionate basis as compared wattage to wattage with the already tested unit.

There will be many variations in construction which should remain within the intent of coverage of the present invention. Some of these variations could use different ballasts, different quantities of lamps per ballast, changes in reflector and or refractor, changes in individual lamp wattages from 32 watt to 55 watts, use of different lens at the bottom of the fixture, changes in quantities of total lamps within the individual fixture, etc. Such modifications may be made to the present invention without departing from the spirit and scope of the present invention, as noted in the appended claims.

We claim:

1. A lighting fixture comprising in combination: a concave, translucent reflector/refractor having therein a small base end and a larger light emitting end, said light fixture having at said small base end thereof a ballast compartment containing a plurality of lamp powering ballasts, each of said lamp powering ballasts being connected to a lamp socket plate having a plurality of sockets for respective plurality of lamps, each of said lamps being provided with individual electrical power from a ballast, independent from electrical power of each other ballast, said concave, translucent reflector/refractor being responsive to transmitting a portion of light from said lamps through said concave, translucent reflector/refractor.

2. The lighting fixture as in claim 1 further comprising a support collar attachable to said ballast compartment, said collar supporting said reflector/refractor, said collar supporting said socket mounting plate, said collar being hollow for insertion therein of a plurality of wire leads to said sockets of said lamps.

3. The socket support plate as in claim 2 further having from 6 to 12 socket mounting positions, said socket mounting plate having an aperture for interior wiring of said sockets, said socket support plate securing a support bracket for said lamps, said socket support plate mountable between 0 to ½ the distance between said smaller base end and said larger light emitting end of said reflector/refractor.

4. The light fixture as in claim 3, further comprising a plurality of sockets fastenable to said socket plate, each said socket containing contacts for energizing each said lamps.

5. The socket as in claim 4 wherein said sockets have a clamping action for securing said lamps in place, said sockets being interchangeable for receiving a desired lamp of a predetermined wattage.

6. The lamps as in claim 1, wherein said lamps have a wattage of at least 32 watts, said lamps being fluorescent.

7. The lamps as in claim 6 wherein said lamps are between 6 to 12 lamps.

8. The reflector/refractor as in claim 1 responsive to reflecting from 99% to 20% of emitted light downward, toward said larger light emitting end.

9. The light fixture as in claim 1 wherein said lamps are symmetrically placed around a center axis of said reflector/refractor.

10. The reflector/refractor as in claim 1 having a translucence for transmitting from 1–80% of said light to pass through said reflector/refractor into an upper hemisphere of from 90 to 130 degrees of light output.

11. The reflector/refractor as in claim 1 further comprising a means to diffuse the produced light.

12. The light fixture as in claim 1 wherein said reflector/refractor is supported by a collar attachable to said ballast compartment.

13. The reflector/refractor as in claim 1 further comprising a light controlling lens added to said larger light emitting end of said reflector/refractor for additional optical control of the produced light which emerges through said larger light emitting end of said lighting fixture end.

14. The ballast compartment as in claim 1 wherein said ballast compartment is attached to said base end of said lighting fixture.

15. The ballast compartment as in claim 1 wherein said ballast compartment is remotely disposed to said lighting fixture.

16. The collar as in claim 2 wherein said collar further has extension tabs supporting said reflector/refractor.

* * * * *